United States Patent [19]

Nickerson

[11] Patent Number: 4,532,009

[45] Date of Patent: Jul. 30, 1985

[54] FORMING BOARD ELEMENTS

[75] Inventor: Leslie F. Nickerson, Clifton Park, N.Y.

[73] Assignee: Albany International, Menands, N.Y.

[21] Appl. No.: 481,287

[22] Filed: Apr. 1, 1983

[51] Int. Cl.[3] ..... D21F 1/00; D21G 9/00

[52] U.S. Cl. ..... 162/351; 162/352; 162/374

[58] Field of Search ..... 162/351, 352, 374

[56] References Cited

U.S. PATENT DOCUMENTS 3,220,920 11/1965 Truxa ..... 162/374
3,573,159 3/1971 Sepall ..... 162/352
3,598,694 8/1971 Wiebe ..... 162/352
4,425,188 1/1984 Fujiwara ..... 162/352

FOREIGN PATENT DOCUMENTS 848522 7/1981 U.S.S.R. ..... 162/312

*Primary Examiner*—Peter Chin
*Attorney, Agent, or Firm*—Kane, Dalsimer, Kane, Sullivan & Kurucz

[57] ABSTRACT

The present invention discloses forming board elements for paper-making machines. The elements are provided with notches on their leading edges for generating longitudinal waves on the forming fabric. These waves induce transversal shear forces within the stock to break up fiber flocs which form within or downstream from the headbox.

14 Claims, 23 Drawing Figures

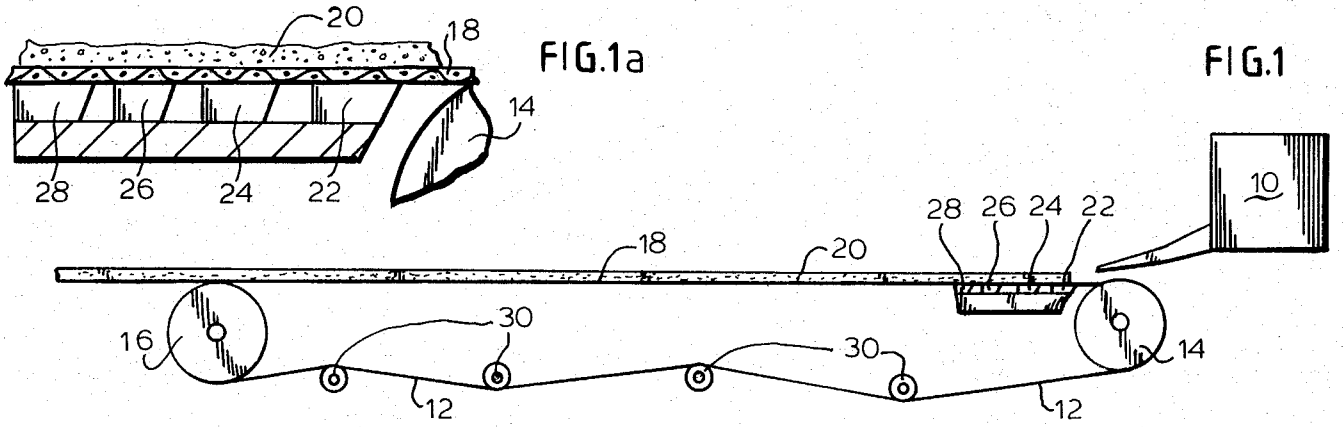
FIG.1
FIG.1a
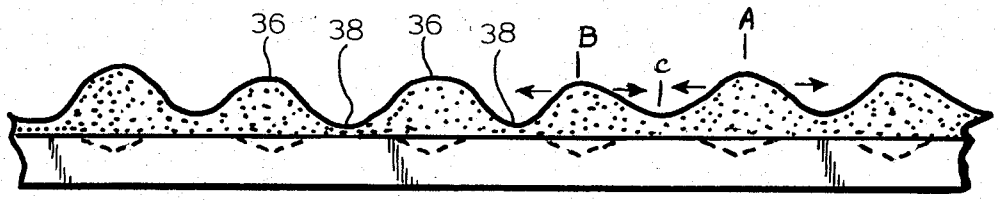
FIG.4a
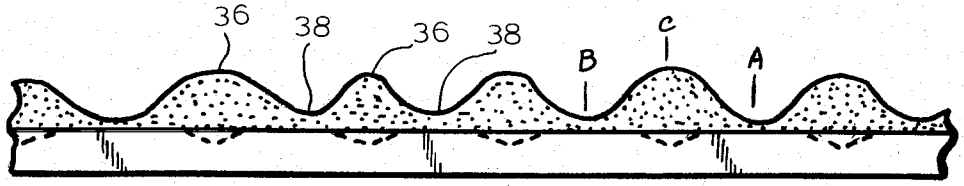
FIG.4b 7b
7b
42
76
72
74
70

8b
80
80
42
32
8b 80
32
80
42
80

80
42
32

FORMING BOARD ELEMENTS

BACKGROUND OF THE INVENTION

1. Field of Invention

This invention pertains to forming boards for a paper making apparatus and more particularly to forming boards which decrease the flocculation of the stock used to form paper.

2. Description of the Prior Art

In the early practice of the art of making paper by hand, the vatman scooped up stock from a vat by means of a mold and then gave the mold a series of shakes or "strokes" while water drained out of the mold. The paper sheet which was formed was very homogenous. Paper manufacturers today using automated machinery strive to obtain a paper sheet which is comparable in uniformity, however most papers manufactured by automatic means lack uniformity. Modern studies have shown that one of the reasons for this lack of uniformity is flocculation of the stock not only in the headbox but also during the relatively short period of time spent by the stock while it is on the forming fabric but before it is formed. This flocculation has been somewhat reduced by the use of rectifier rolls inside the headbox, and transversal shakers disposed under the forming fabric. It has been found however that as the speed of the fabric is increased, these methods become less effective. It appears that the vatman's stroke dispersed the flow of stock by inducing therein complex shears, and that in order to produce high-quality paper at high speeds, new means must be found for emulating the stroke at high speeds.

Several methods have been suggested for breaking up the flocs deposited or formed on the forming fabric, by creating a turbulence in the stock. For example the Sepal U.S. Pat. No. 3,573,159 and Johnson U.S. Pat. No. 3,874,998 have suggested forming boards having transversal channels for creating transversal waves extending across the fabric. However these methods were still found to be insufficient.

Recently Otto J. Kallmes and Manuel Perez have suggested the successive generation and destruction of waves which extend longitudinally with respect to the forming fabric as an effective deflocculation means for high speed papermaking machines. This type of action forces relatively large transversal movement of stock during the forming process due to transversal shear thus breaking up and/or limiting the formation of flocs therein. Messrs. Kallmes and Perez' work was described at the 1982 Papermakers Conference, and published by TAPPI.

OBJECTIVES AND SUMMARY OF THE INVENTION

The objective of this invention is to provide a forming board having elements which generate longitudinal waves in the stock on a forming fabric of a papermaking machine.

Another objective is to provide forming board elements which have a relatively simple shape, and therefore are easy to manufacture.

Other objectives and advantages shall become apparent in the description presented below.

According to this invention waves are formed in the stock deposited on a forming fabric, said waves being characterized by longitudinal ridges and valleys, by providing a plurality of forming board elements positioned under the fabric, each element having an upstream transversal edge with a plurality of spaced notches extending transversally across the fabric. As the fabric and the stock travel across each board, the water tends to drain through the fabric and is forced back into the stock by these notches.

BRIEF DESCRIPTION OF THE DRAWINGS

FIGS. 1 and 1*a* shows a Fourdrinier papermaking machine incorporating the present invention;

FIGS. 4*a* and 4*b* show cross-sectional views of the effects of the forming board elements of FIGS. 2 and 3 respectively;

DETAILED DESCRIPTION OF THE INVENTION

Figure 2:
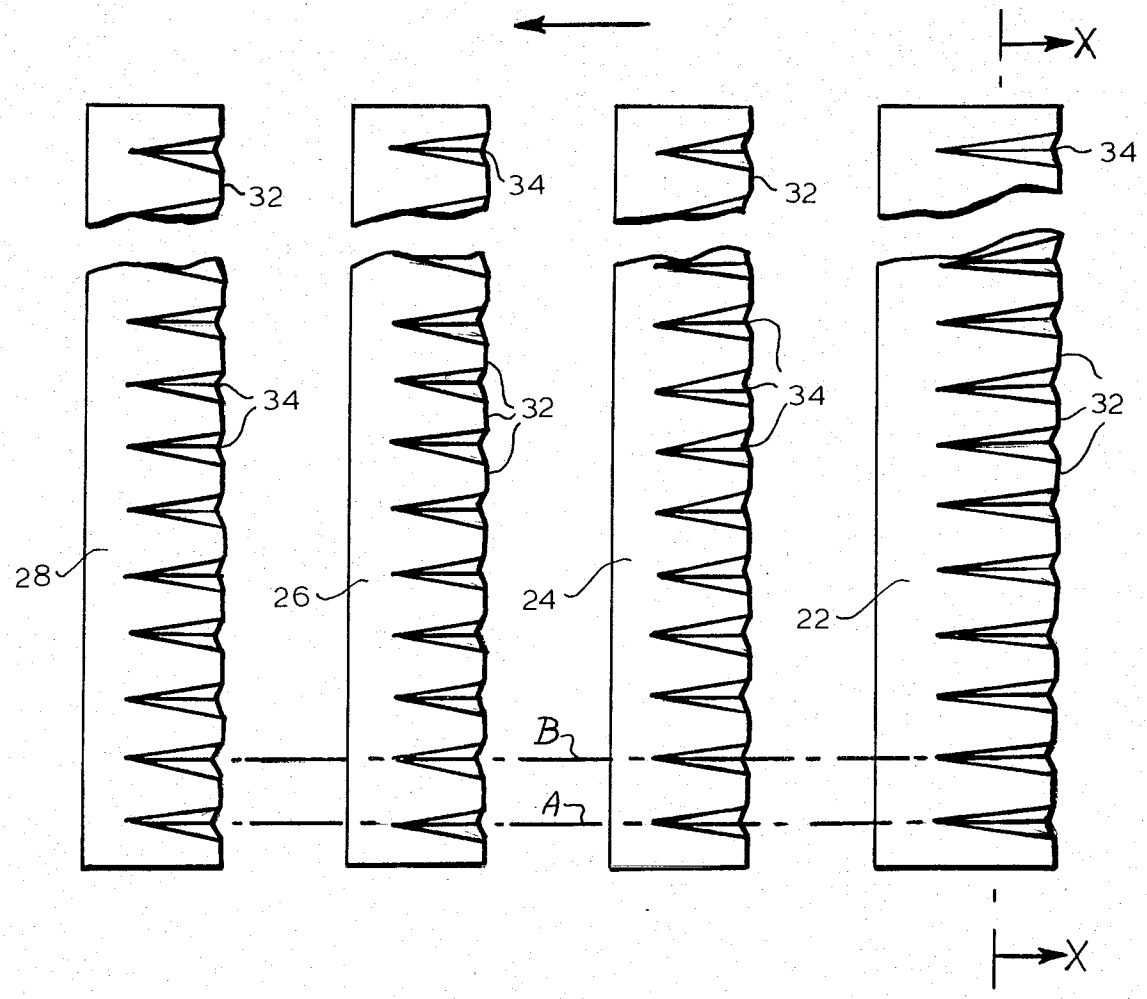
FIG. 2 shows a plan view of the forming board elements.

For illustrative purposes the invention will be described in conjunction with a Fourdrinier paper-making machine. As shown in FIGS. 1 and 1*a*, a Fourdrinier machine comprises a headbox 10, a forming fabric 12, and breast and couch rolls 14 and 16. The forming fabric is continuous and travels between the breast and the couch rollers. The stock is deposited from the headbox on the top surface 18 of the fabric. Immediately following the headbox the fabric is passed over a forming board consisting of several elements, 22, 24, 26, and 28. During this stage, some water is drained from the stock and its fibers settle in a thin wet sheet 20 completing the forming of the paper. Following passage over the forming board the sheet is transported past various other dewatering devices such as foils and vacuum boxes. These devices are well-known in the art and therefore are not described. At the couch roll 16, sheet 20 is removed and passed on to the press and dryer sections. The forming fabric is returned by rollers 30 to breast roll 14.

Forming board elements 22–28 shall now be described in more detail. It should be understood that while the Figures presented herein show four forming board elements, the present invention is not limited to only four elements but is applicable to any number of such elements.

As can be seen in FIG. 2, forming board elements 22, 24, 26, and 28 are positioned transversal to the direction of movement of the forming fabric indicated by the arrow. Each element has a leading or upstream edge 32 on which there is provided a plurality of notches 34. These notches are preferably equally spaced along the length of each board. As the fabric travels from the headbox, the water that drains from the stock through the fabric is pushed by the notches upwards back into the stock to form longitudinal waves therein. A cross-sectional view taken slightly downstream of the notches such as at line X—X of FIG. 2 shows a plurality of waves (see FIG. 4*a*) comprising ridges 36 and valleys 38. Each ridge corresponds to one of the notches 34. The forming board elements may be oriented so that the notches of each board are aligned with each other, i.e. two imaginary lines A and B drawn in the longitudinal direction would pass through respective notches 34 in each of the elements. This alignment produces clear, well defined ridges and valleys because, as the stock relaxes as it passes between the elements, it is pushed up again by the notches of the next forming board element. This generation and re-enforcement of longitudinal waves causes a transversal shear within the stock which results in a transversal shift or migration of the stock fibers which breaks up the flocs.

The transversal shear described above is increased if each successive element phase shifts the waves transversally instead of merely re-inforcing it. This is accomplished by positioning the second and fourth forming board elements so that their notches are located halfway between the notches of the first and third elements, as shown in FIG. 3.

Figure 3:
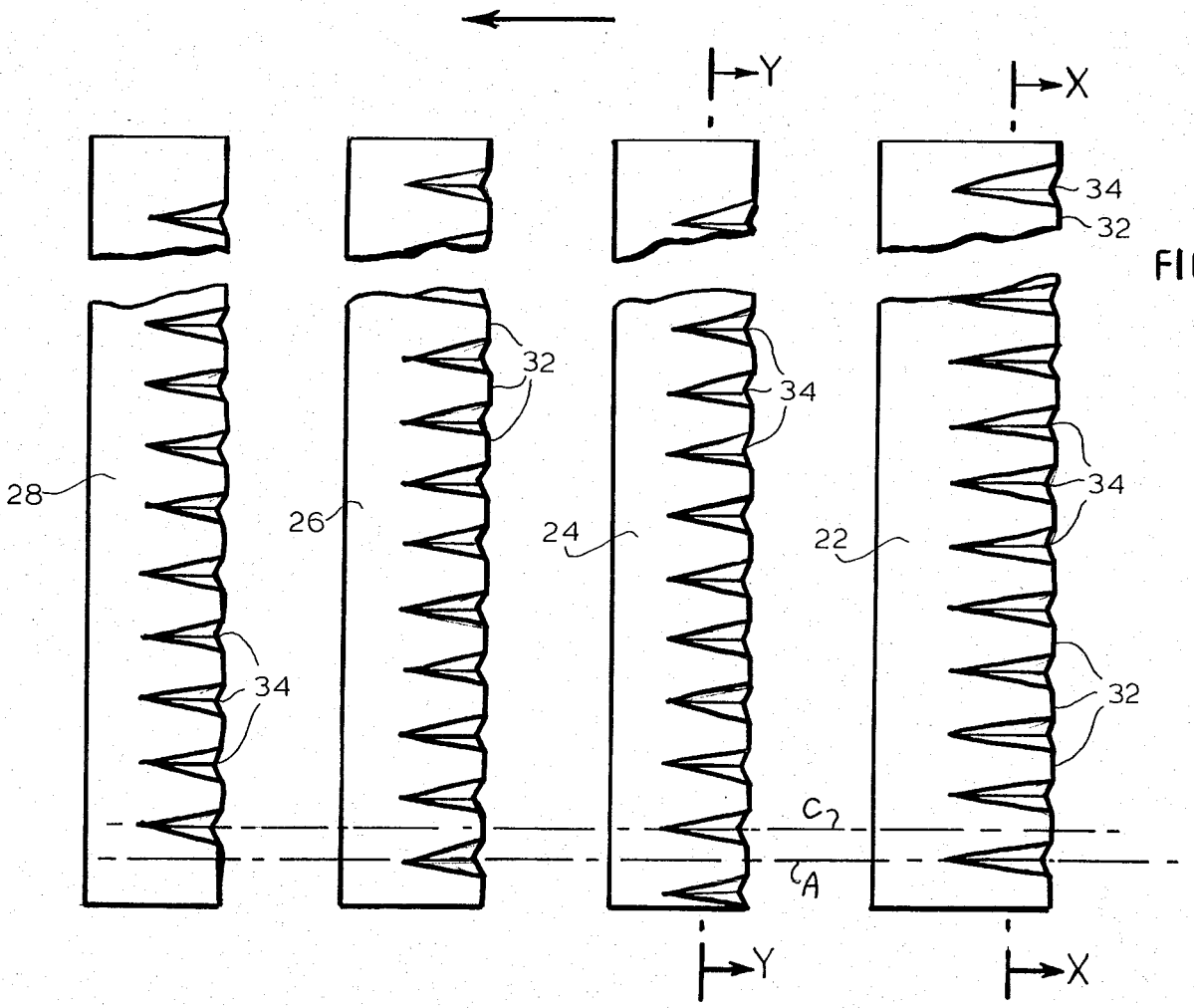
FIG. 3 shows a plan view of the forming board elements having an alternate arrangement.

In FIG. 3, the notches of elements 22 and 26 are aligned along an imaginary line such as A while the notches of elements 24 and 28 are aligned along an imaginary line C. The effects of this configuration are illustrated in FIGS. 4*a* and 4*b*, wherein FIG. 4*a* is a profile of the waves taken along line X—X of FIG. 3, somewhat downstream from the notches of element 22, while Figure B is a profile of the waves taken along line Y—Y downstream of the notches of element 24.

A comparison of FIGS. 4*a* and 4*b* reveals that a 180° phase shift takes place between lines X—X and Y—Y so that the ridges of FIG. 4*a* correspond to the valleys of FIG. 4*b* and vice versa. Obviously this effect can take place only if the fibers forming the ridges in FIG. 4*a*, such as ridges A and B move sidewise in the directions indicated by the arrows to form the ridges C and valleys A and B of FIG. 4*b*. The process is repeated between each successive board causing rapid transversal movement of the stock fibers, and consequently, deflocculation.

The notches required to perform the above-described functions can be of a plurality of shapes. Some of these shapes are illustrated in FIGS. 5 through 10 and described hereinbelow.

Figure 5A:
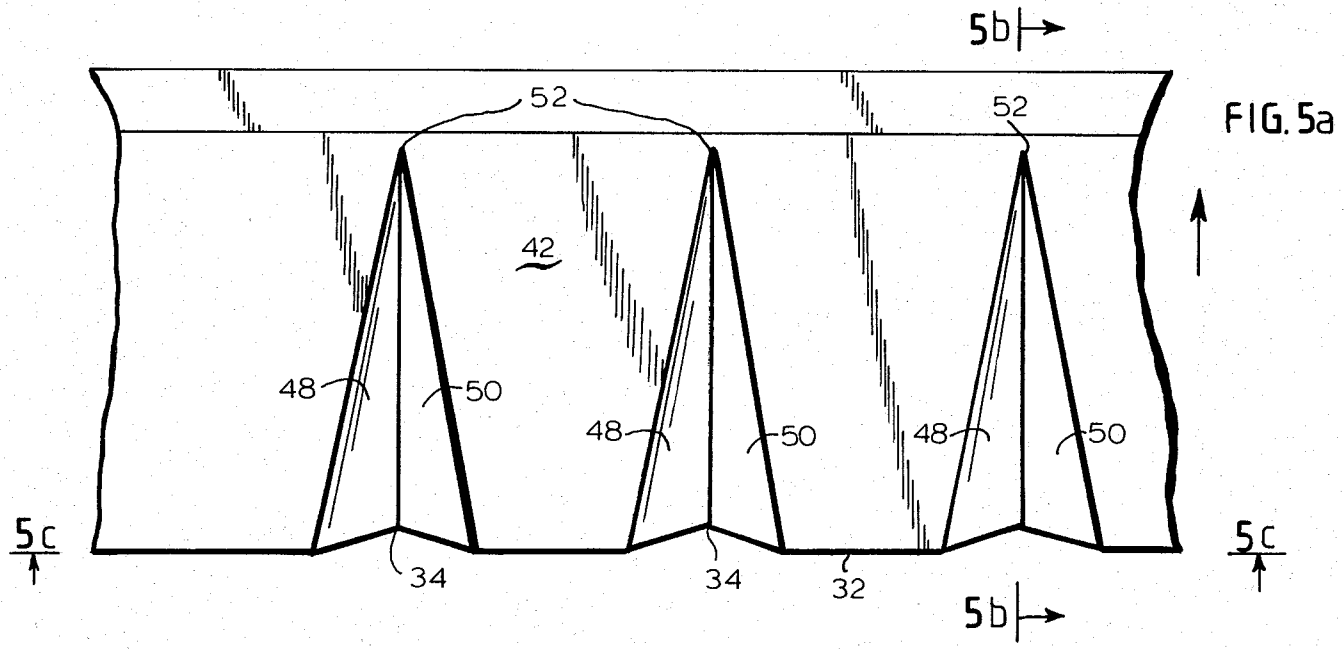
FIGS. 5*a, b,* and *c* show details of the forming board elements of FIG. 2.
Figure 5C:
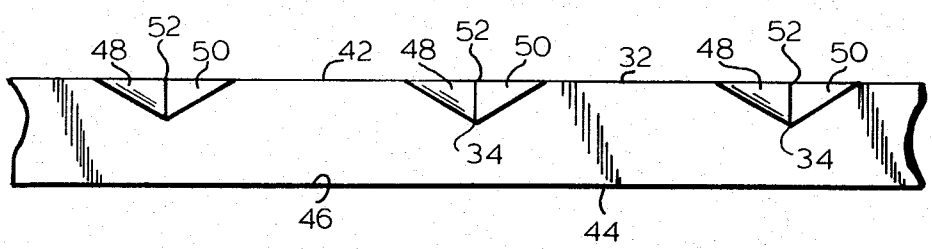
Figure 5B:
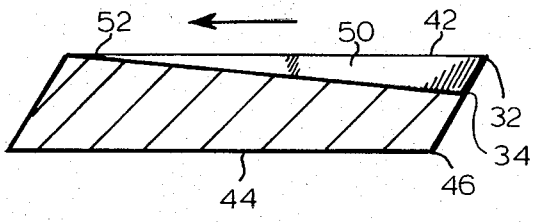

In FIG. 5 the basic shape of the forming board element is shown as having a parallelogramic cross-section with the top surface 42 having a leading edge 32 which is more upstream from the leading edge 46 of bottom surface 44. This shape is well suited for leading some water away from the wire as the wire slides across top surface 42. Notches 34 are formed by cutting pyramid-shaped pieces out of the board. Thus a typical notch has two plane surfaces 48 and 50 which are angled with respect to each other and with top surface 42. In this particular embodiment each notch 34 has the shape of a triangular trench which narrows in the machine downstream direction to a point 52 located on surface 42. When forming board elements of the type shown in FIG. 5 are used in a Fourdrinier assembly the element leads some of the water, which penetrates the forming fabric, away from it except at the notches where the water is channeled and pushed back through the wire by the trench to form the longitudinal waves described above. The relative length, width, depth, and spacing of the notches may be varied in accordance with the speed of the fabric, the consistency of the stock and the desired finish of the final product.

The mode of generating longitudinal waves described hereinabove in conjunction with the embodiments of FIG. 5 applies as well to the other embodiments described below, unless otherwise noted.

Figure 6B:
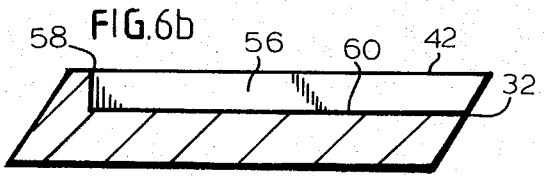
FIGS. 6*a, b,* and *c* show a second embodiment of the forming board element.
Figure 6A:
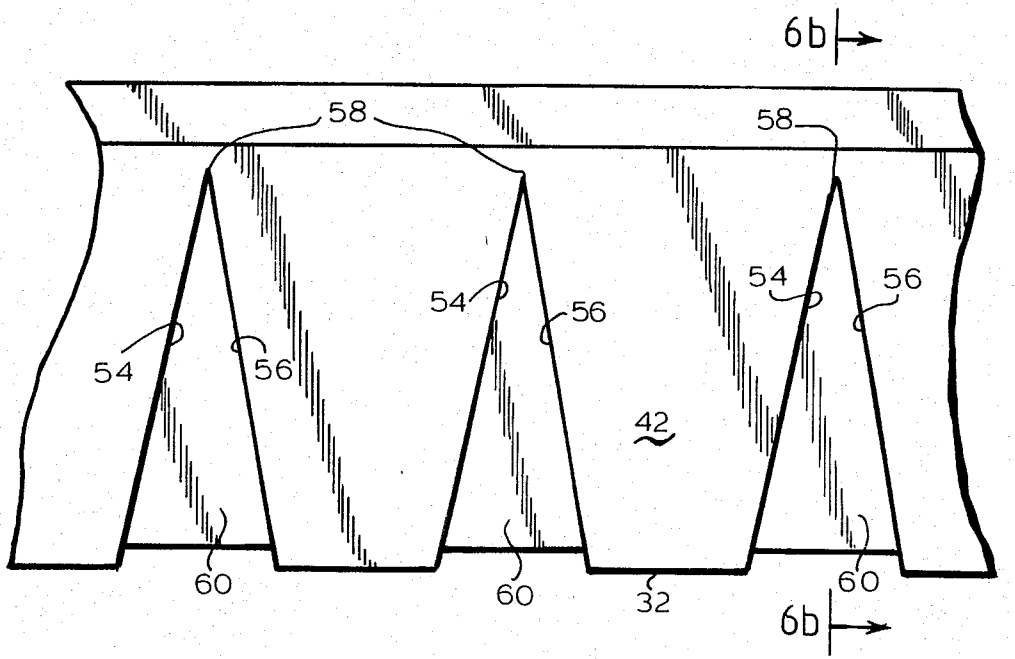
Figure 6C:
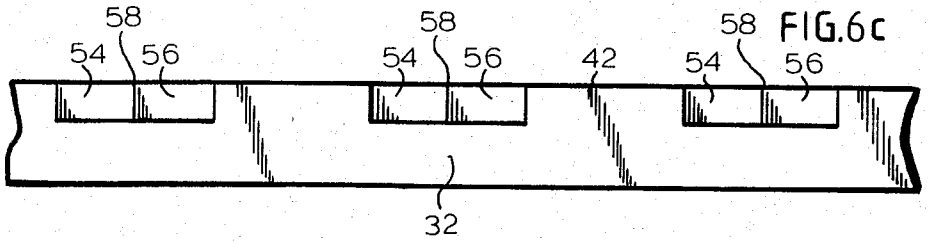

A second configuration for the notch is shown in FIG. 6. In this embodiment, the notch is formed by cutting a wedge or pie-shaped piece out of the forming board. Thus the notch has two side walls 54 and 56 which are approximately perpendicular to the top surface 42 and are at an angle to each other to form an apex 58. The bottom 60 of the notch is approximately parallel to top surface 42. In this embodiment as the side walls approach each other in the downstream direction the water is again driven upward.

Figures 7A, 7B, 7C:
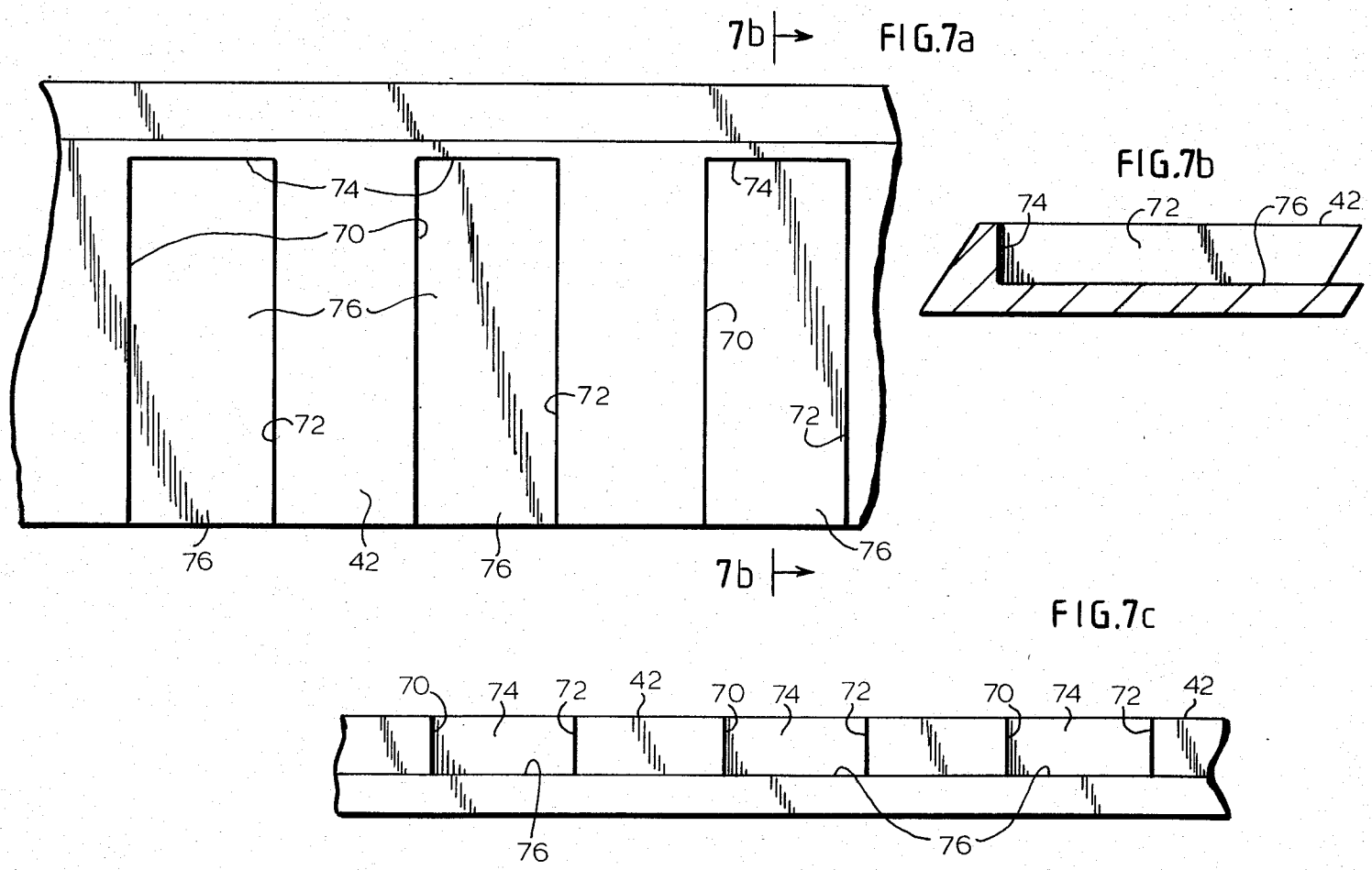
FIGS. 7*a, b,* and *c* show a third embodiment of the forming board element.

FIG. 7 shows another embodiment in which each notch comprises a rectangular trough having side walls 70,72, end wall 74 and a bottom 76. Walls 70,72, are parallel to each other and perpendicular to top surface 42 while end wall 74 is perpendicular to both side walls and the top surface. The bottom is parallel to the top surface. This embodiment works in the same way as the pyramid-shape notch of FIG. 5.

Figures 8A, 8B, 8C:
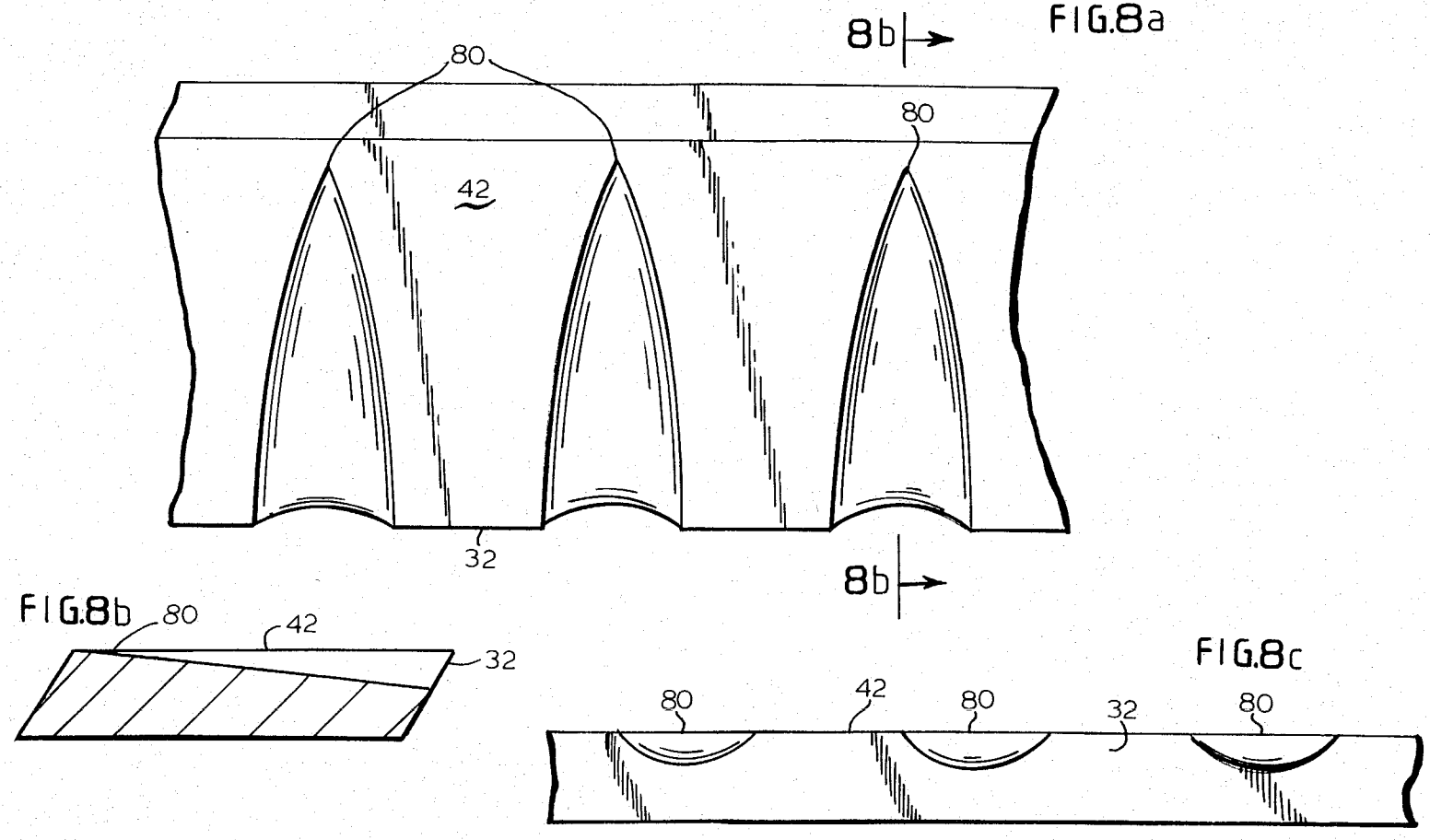
FIGS. 8*a, b,* and *c* show a fourth embodiment of the forming board element.

The embodiment of FIG. 8 is similar to the pyramid-shape notch of FIG. 5 except that the notch is formed by a single curvilinear surface generated by cutting sections of circles perpendicular to top surface 42 with decreasing width as the notch extends away from the leading edge 32 ending in a point 80. Preferably to the curvilinear surface is cylindrical.

Figure 9A:
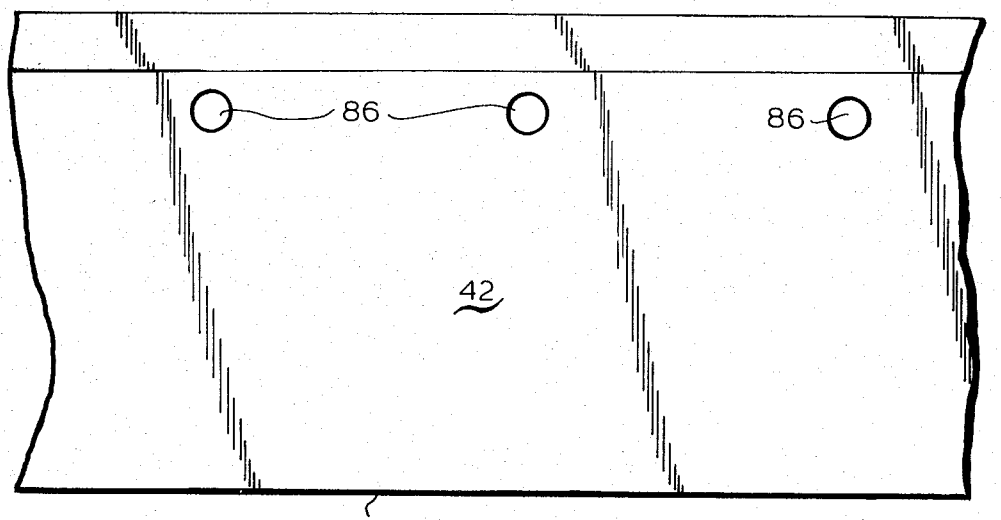
FIGS. 9*a, b,* and *c* show a fifth embodiment of the forming board element.
Figure 9B:
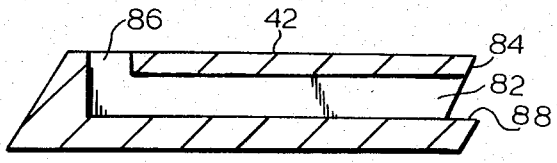
Figure 9C:
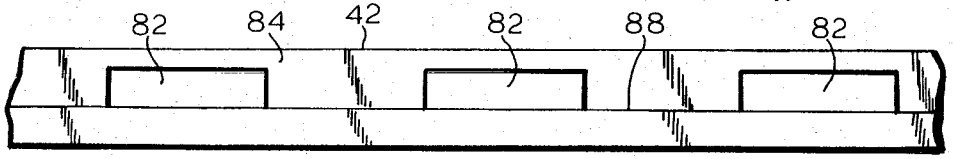
Figure 10A:
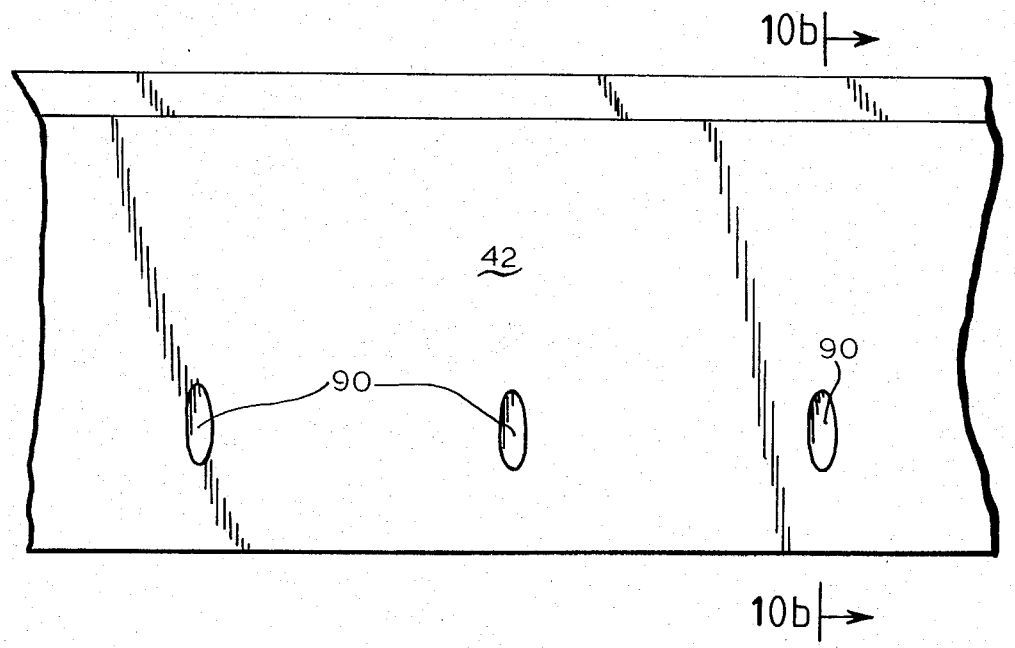
FIGS. 10*a, b,* and *c* show a sixth embodiment of the forming board element.
Figure 10B:
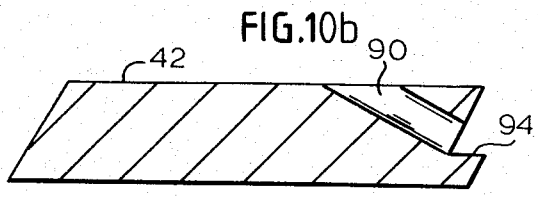
Figure 10C:
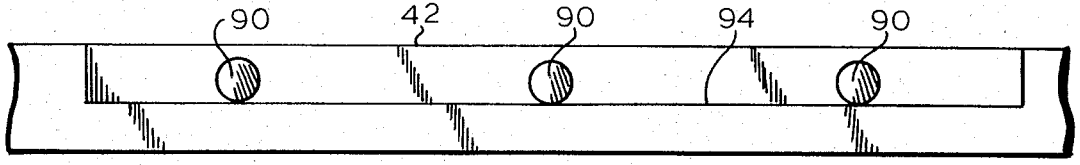

In the embodiments of FIGS. 9 and 10 the waves are generated by actually separating streams of water from the wire and then thrusting them back at the fabric 12. In FIG. 10, the notches are formed by making a rectangular hole 82 through the leading side 84 and parallel with top surface 42, and a second hole 86 drilled perpendicularly through top surface 42 to meet the rectangular hole. Preferably the leading side 84 is made with a ledge 88 so that as the water is being drained from the fabric by said leading side, it is channelled by the ledge into hole 82, and from there back to the fabric, via hole 86. Of course this whole process takes place only when the fabric is moving fast enough so that the water retains some of its longitudinal momentum while being drained.

FIG. 10 shows a simplified embodiment of the configuration of FIG. 9. In this embodiment, instead of two holes, a single hole 90 is drilled between the leading side 92 and top surface 42. Ledge 94 is provided for channeling the drained water back to the fabric through hole 90.

In summary, the present invention provides forming boards with notches for generating and regenerating longitudinal waves through stock deposited by a headbox on a forming fabric. The waves cause transversal shear within the stock causing any flocs formed therein to disperse.

It is obvious that in addition to the embodiments described hereinabove, other configurations can be made without departing from the scope of the invention as defined in the appended claims.

I claim:

1. A continuous papermaking apparatus comprising a forming fabric moving in a continuous loop;

means for depositing stock on the forming fabric comprising particles or fibers in suspension; and forming board elements disposed transversally and successively under said fabric, each of said forming board elements having a top surface with a leading edge and a trailing edge in contact with said forming fabric and a leading side surface disposed transversally to the direction of movement of said fabric upstream of and generally at an acute angle to said top surface thereby draining water from said stock, and a plurality of notches extending from said leading side surface to a point between said leading and trailing edges on said top surface to force a portion of the drained water back into the stock;

whereby any flocs formed in said stock are dispersed in the transversal shear generated by said waves.

2. The apparatus of claim 1 wherein the notches of respective elements are aligned to reinforce the waves.

3. The apparatus of claim 2 wherein each of said notches extends across said top surface of said elements.

4. The apparatus of claim 3 wherein each of said notches has width and depth which narrows as the respective notch extends away from said respective leading side surface.

5. The apparatus of claim 1 wherein the notches of adjacent board elements are positioned to phase-shift transversally said waves.

6. The apparatus of claim 5 wherein each said notch extends across the top surface of said elements.

7. The apparatus of claim 6 wherein each of said notches has width and depth which narrows as the respective notch extends away from said respective leading edge.

8. The apparatus of claim 1 wherein each of the notches has a cross-section which becomes smaller as the respective notch extends away from said leading side surface.

9. The apparatus of claim 8 wherein said cross-section is triangular with its apex pointing away from said top surface.

10. The apparatus of claim 8 wherein said cross-section is ovoidal.

11. The apparatus of claim 8 wherein said cross-section is rectangular.

12. The apparatus of claim 1 wherein said notch has a rectangular cross-section.

13. The apparatus of claim 1 wherein each of said notches comprises a first hole drilled through said leading side substantially in parallel to said top surface and a second hole drilled through said top surface to meet said first hole.

14. The element of claim 1 wherein each of said notches comprises a hole drilled between said top surface and said leading side surface.

* * * * *